US007207845B1

(12) United States Patent
Yi

(10) Patent No.: US 7,207,845 B1
(45) Date of Patent: Apr. 24, 2007

(54) MULTI-FUNCTION ELECTRICAL CONNECTOR

(75) Inventor: Chong H. Yi, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/476,296

(22) Filed: Jun. 28, 2006

(51) Int. Cl.
*H01R 24/00* (2006.01)

(52) U.S. Cl. ..... 439/660

(58) Field of Classification Search ..... 439/70, 439/660, 576, 357
See application file for complete search history.

(56) References Cited

U.S. PATENT DOCUMENTS 3,345,541 A * 10/1967 Cobaugh et al. ..... 361/808
4,192,565 A * 3/1980 Gianni ..... 439/69
4,354,718 A * 10/1982 Bright et al. ..... 439/73
4,491,378 A * 1/1985 Crawford ..... 439/325

* cited by examiner

*Primary Examiner*—Phuong Dinh
(74) *Attorney, Agent, or Firm*—Wei Te Chung

(57) ABSTRACT

An electrical connector (100) includes a first housing piece (2), a second housing piece (3) interrelated with the first housing piece, and a number of contacts (4) assembled to the first and second housing pieces. The first housing piece forms a plurality of contact passages (200) on outer sides of longitudinal walls (21, 22). The second housing piece forms a plurality of guards (315), and defines a plurality of receiving spaces (316) between adjacent guards corresponding to the contact passages. The contact comprises a tail portion (42) arranged adjacent to a bottom surface of the first housing piece, a retention portion (42) engaging with the contact passages, and a mating portion (41) received in the receiving space of the second housing piece.

5 Claims, 13 Drawing Sheets

MULTI-FUNCTION ELECTRICAL CONNECTOR

BACKGROUND OF THE INVENTION

1. Field of the Invention

The present invention generally relates to an electrical connector, and more particularly to an electrical connector used for Vacuum Florescent Displays (VFD).

2. Description of Related Art

Vacuum Florescent Displays (VFD) or Vacuum Florescent Tubes (VFT) are used as commercial displays in automotive modules, such as electronic climate controls, clocks and radios, and in consumer electronics and appliances, such as microwaves, clocks, stereos, DVD and VCR players. The basic structure of the VFT is a three-layer glass sandwich with the center layer being hollow to contain electronics and light emitting phosphors. Metal leads are integrated into the sides of the glass sandwich to permit the input and output of electrical signals. These leads also double as mechanical supports. The VFT is mounted to a printed circuit board (PCB) with each lead firstly hand soldered by through hole technology and a secondary through hole soldering (wave or selective). This manner is time-consuming and costly without doubt. Of course, Surface Mount Device (SMD) reflow soldering of the leads to the PCB is also feasible. However, the elevated reflow temperatures cause a reduction in VFT intensity. Current industry trend is to eliminate through hole soldering in favor of all SMD designs to reduce overall manufacturing costs. However, when VFTS are used, the requirement for "all SMD design" is prevented from being achieved.

On the other hand, with the development of industry, the number of leads required per display has been reduced. For automotive and other high vibration applications, the specific issue is that the VFT has a high mass that cannot be rigidly supported with few leads. In addition, the leads are very slim in configuration, very prone to being deformed during shipping or soldering. Thus, the electrical connection between VFTS and the PCB is not stable.

Summarily, a holder is highly needed to solve above-mentioned problems.

BRIEF SUMMARY OF THE INVENTION

Accordingly, an object of the present invention is to provide an electrical connector doubling as a support holder.

A second object of the present invention is to provide an electrical connector which reduces soldering process time and reduces vibration in panel.

In order to achieve the above-mentioned object, an electrical connector in accordance with the present invention comprises an insulative housing and a plurality of contacts assembled to the insulative housing. The housing comprises a top wall, a bottom wall opposite to the top wall and a pair of lengthwise walls connecting with the top and bottom walls. A plurality of contact passages is defined adjacent to a lower portion of the lengthwise walls and extending upwardly. A plurality of guards is defined in the lengthwise walls, and a receiving space corresponding to the contact passage is defined between two adjacent guards. The contacts are assembled in the contact passages. Each contact comprises a tail portion arranged adjacent to the bottom wall, and a mating portion extending in a corresponding receiving space between the guards.

Other objects, advantages and novel features of the invention will become more apparent from the following detailed description of the present embodiment when taken in conjunction with the accompanying drawings.

DETAILED DESCRIPTION OF THE INVENTION

Figure 1:
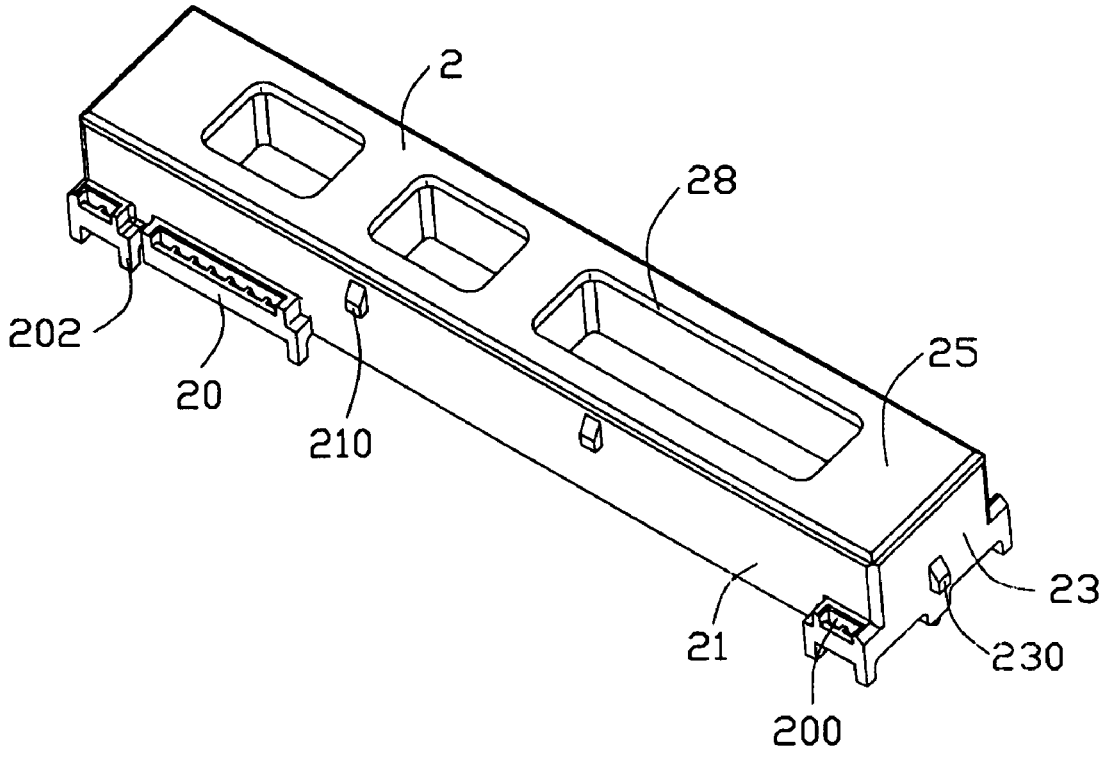
FIG. 1 is a perspective view of a first housing piece of an electrical connector in accordance with the present invention.

Reference will now be made to the drawing figures to describe the present invention in detail.

Referring to FIGS. 7–10, an electrical connector 100 in accordance with the present invention comprises an insulative housing comprising a first housing piece 2 and a second housing piece 3 interrelated with the first housing piece 2, and a plurality of contacts 4 assembled to the first and the second housing pieces 2, 3.

Figure 2:
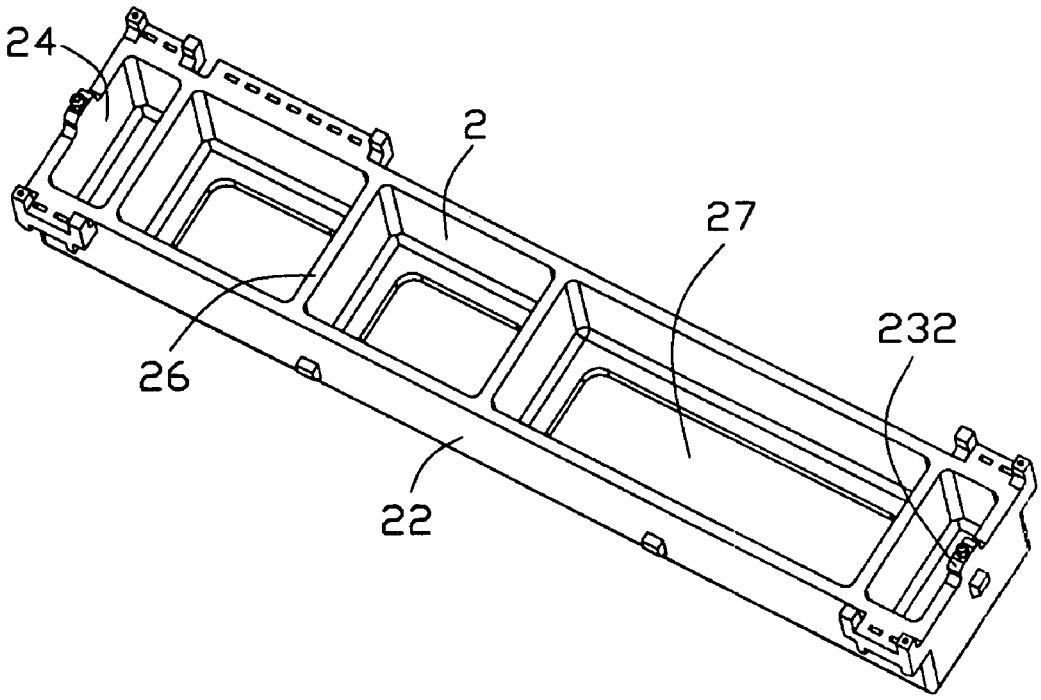
FIG. 2 is a view similar to FIG. 1, but viewed from a different angle.

In conjunction with FIGS. 1–2, the first housing piece 2 is of rectangular shape and comprises a pair of first and second longitudinal walls 21, 22, a pair of lateral walls 23, 24 respectively connecting with the longitudinal walls 21, 22. The first housing piece 2 also comprises a top and a bottom surfaces 25, 26. A plurality of blocks 20 are formed on lower portions of the first and the second longitudinal walls 21, 22 with bottom surfaces thereof coplanar with the bottom surface 26. Each block 20 define a plurality of contact passages 200 extending therethrough and forms a pair of standoffs 202 extending downwardly from the bottom surface thereof. Each longitudinal wall 21, 22 spaced arrange a pair of first latches 21 adjacent to the top surface 25 of the first housing piece 2. Each lateral wall 23, 24 forms a second latch 230 adjacent to the bottom surface 26 of the first housing piece 2 and forms a polarization 232 extending downwardly from the bottom surface 26 and in alignment with the second latch 230. The first housing piece 2 defines a plurality of different-size cavities 27 extending upwardly from the bottom surface 26 thereof. The top surface 25 defines a plurality of cutouts 28 with relatively small size to communicate with some cavities 27.

Figure 3:
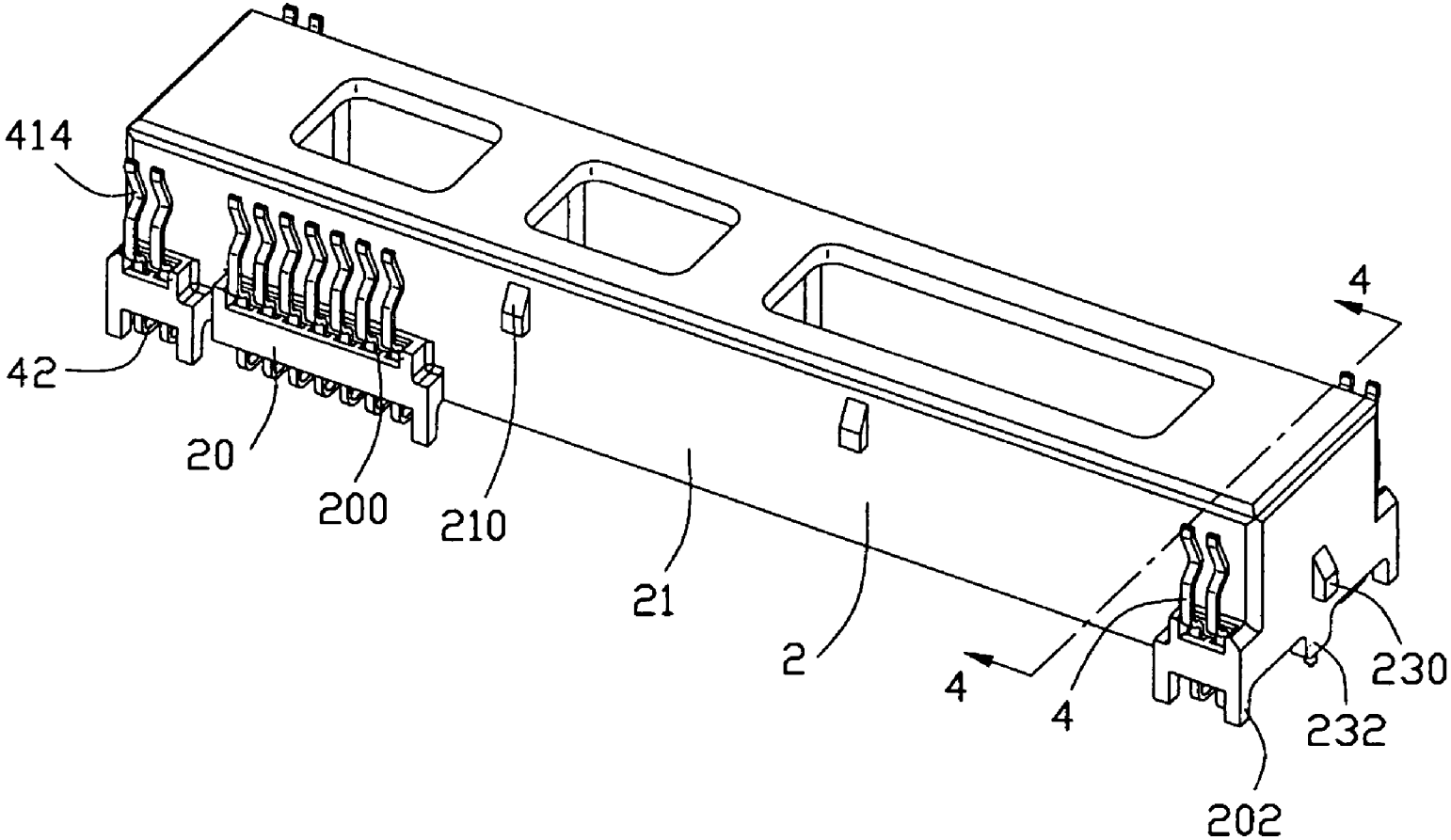
FIG. 3 is an assembled view of the first housing piece and contacts of the electrical connector of the present invention.
Figure 4:
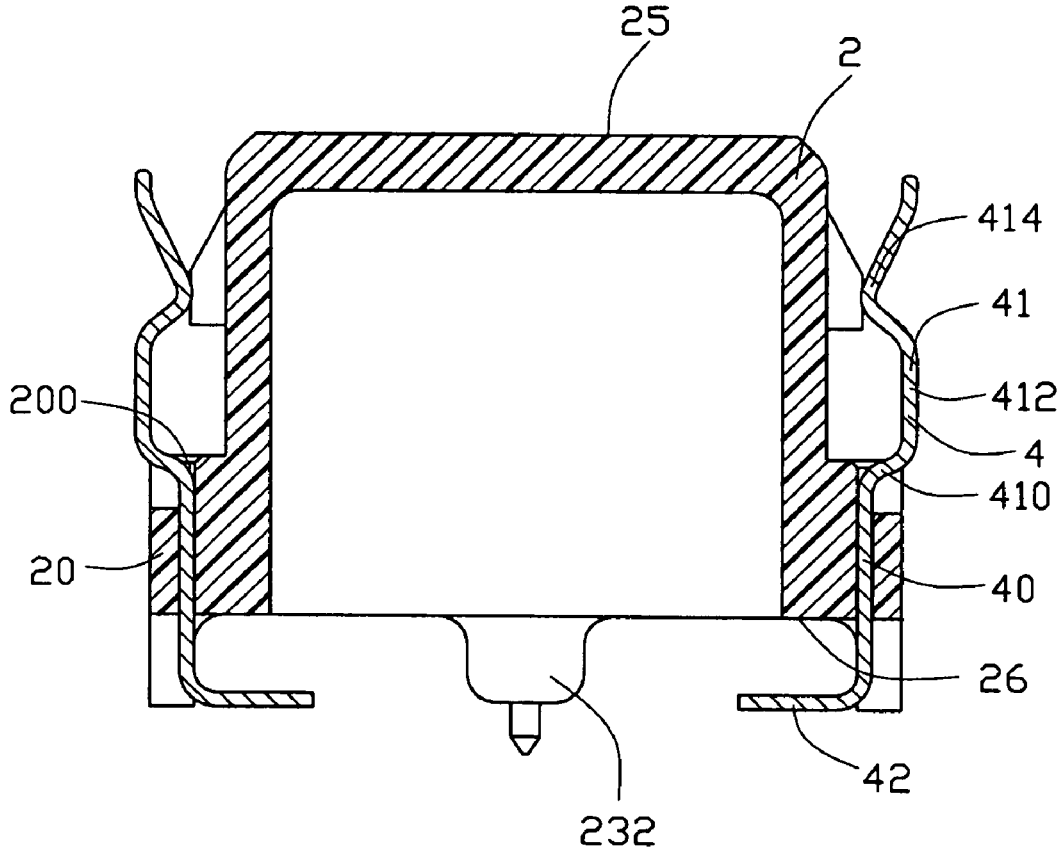
FIG. 4 is a cross-sectional view taken along line 4—4 of FIG. 3.

In conjunction with FIGS. 3 and 4, each contact 4 comprises a retention portion 40, a mating portion 41 extending upwardly from the retention portion 40 and a connecting portion 42 extending downwardly from the retention portion 40. The contacts 4 are respectively assembled to the first housing piece 2 with the retention portions 40 thereof received in the passageways 200 of the blocks 20. The mating portion 41 comprises an upright section 412 parallel to the retention portion 40, an inclined connecting section 410 extending outwardly from the retention portion 40 and connecting with the upright section 412, and a curved mating section 414 curved toward the longitudinal wall 21, 22.

Figure 5:
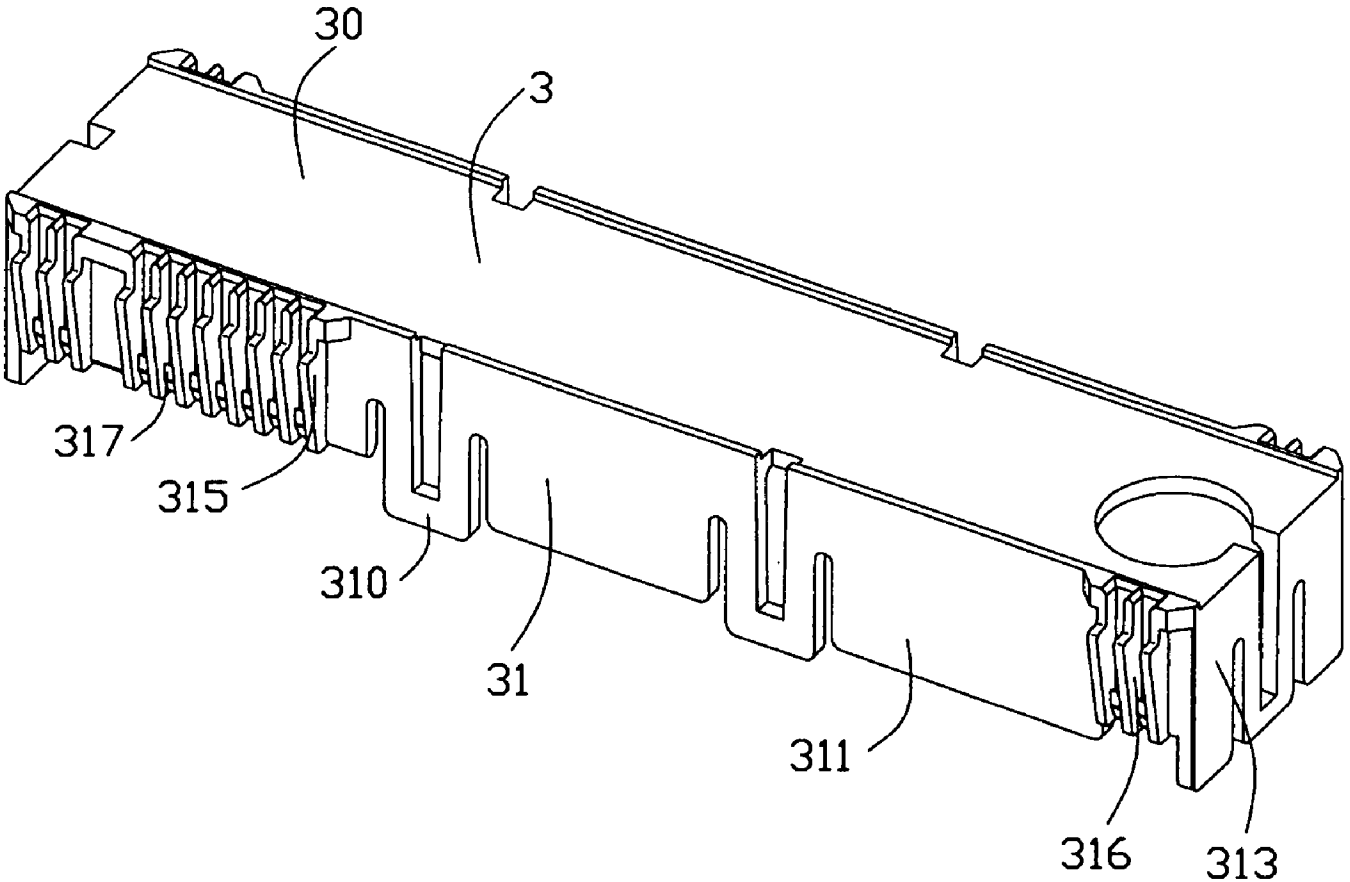
FIG. 5 is a perspective view of a second housing piece of the electrical connector of the present invention.
Figure 6:
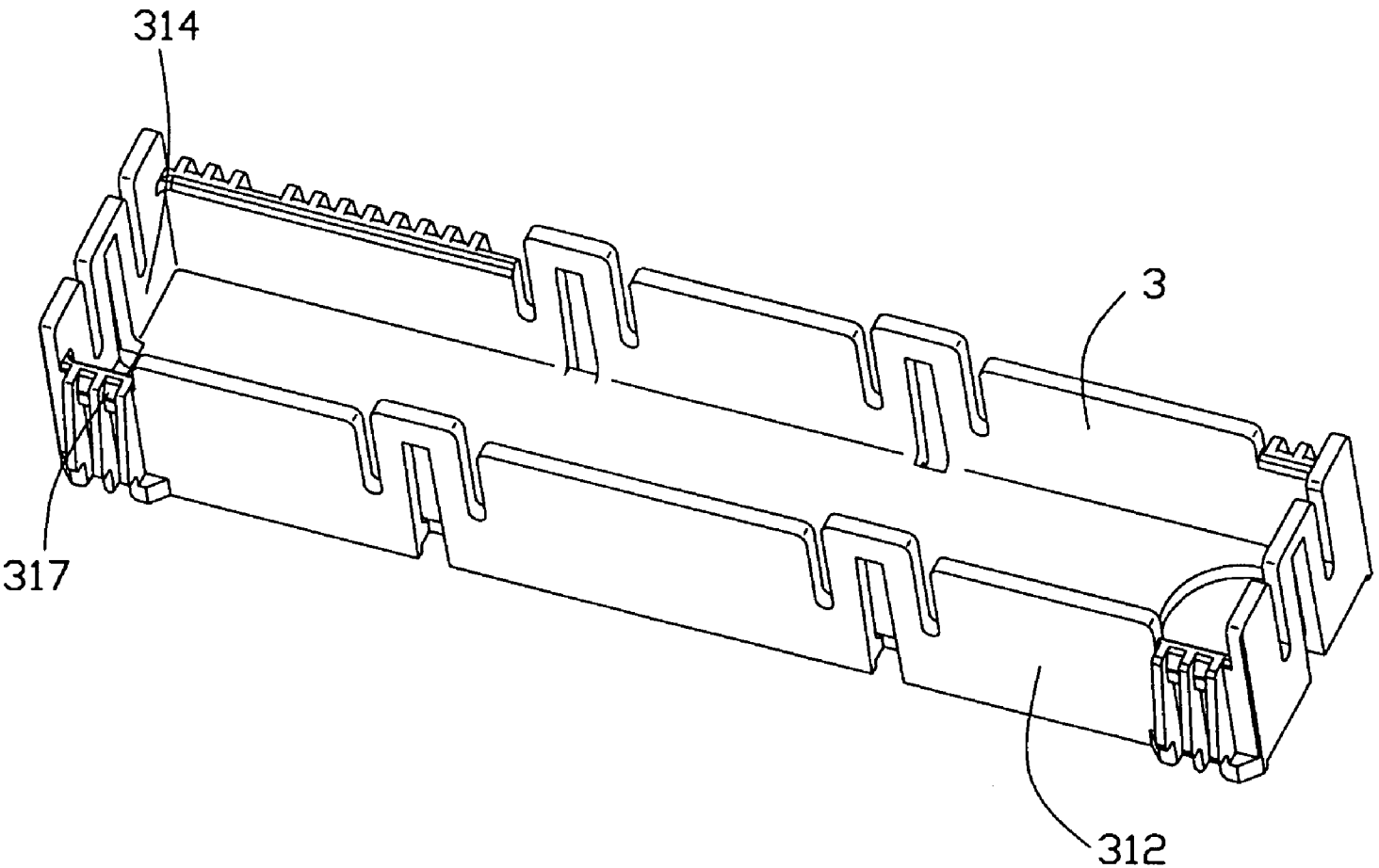
FIG. 6 is a view similar to FIG. 5, but taken from a different angle.
Figure 7:
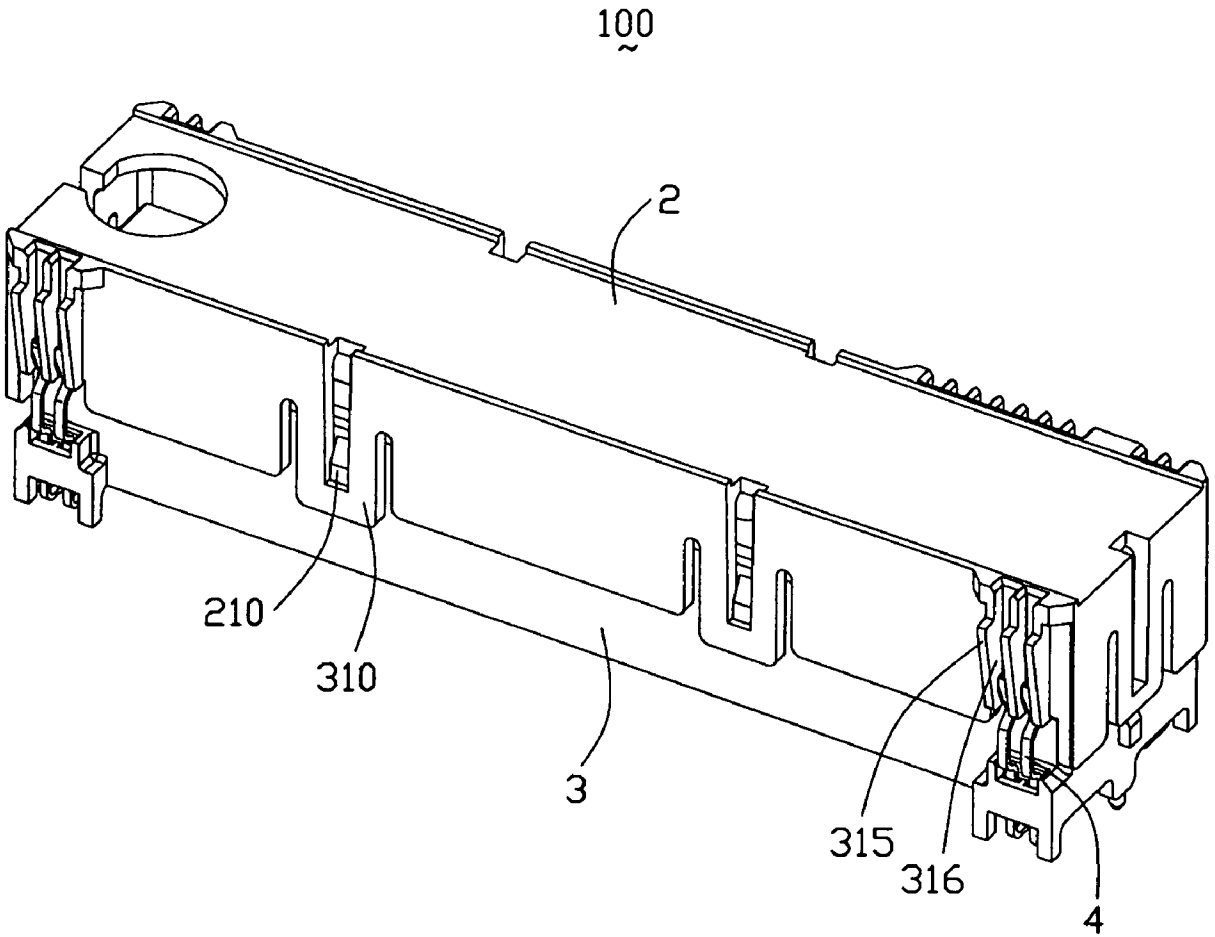
FIG. 7 is a partially assembled view of the electrical connector with the second housing piece partially assembled to the first housing piece and the contacts.
Figure 8:
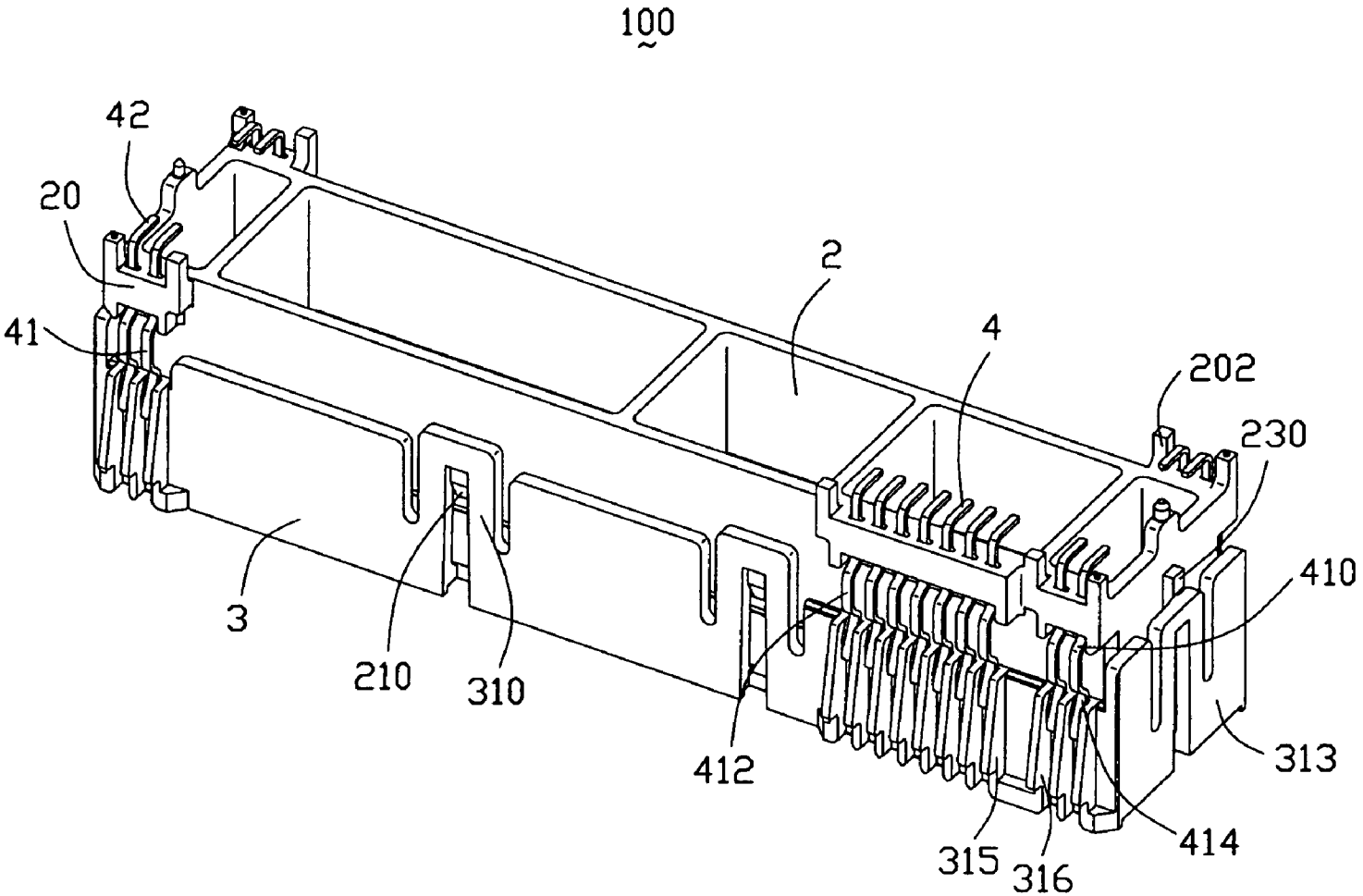
FIG. 8 is a view similar to FIG. 7, but viewed from a different angle.
Figure 9:
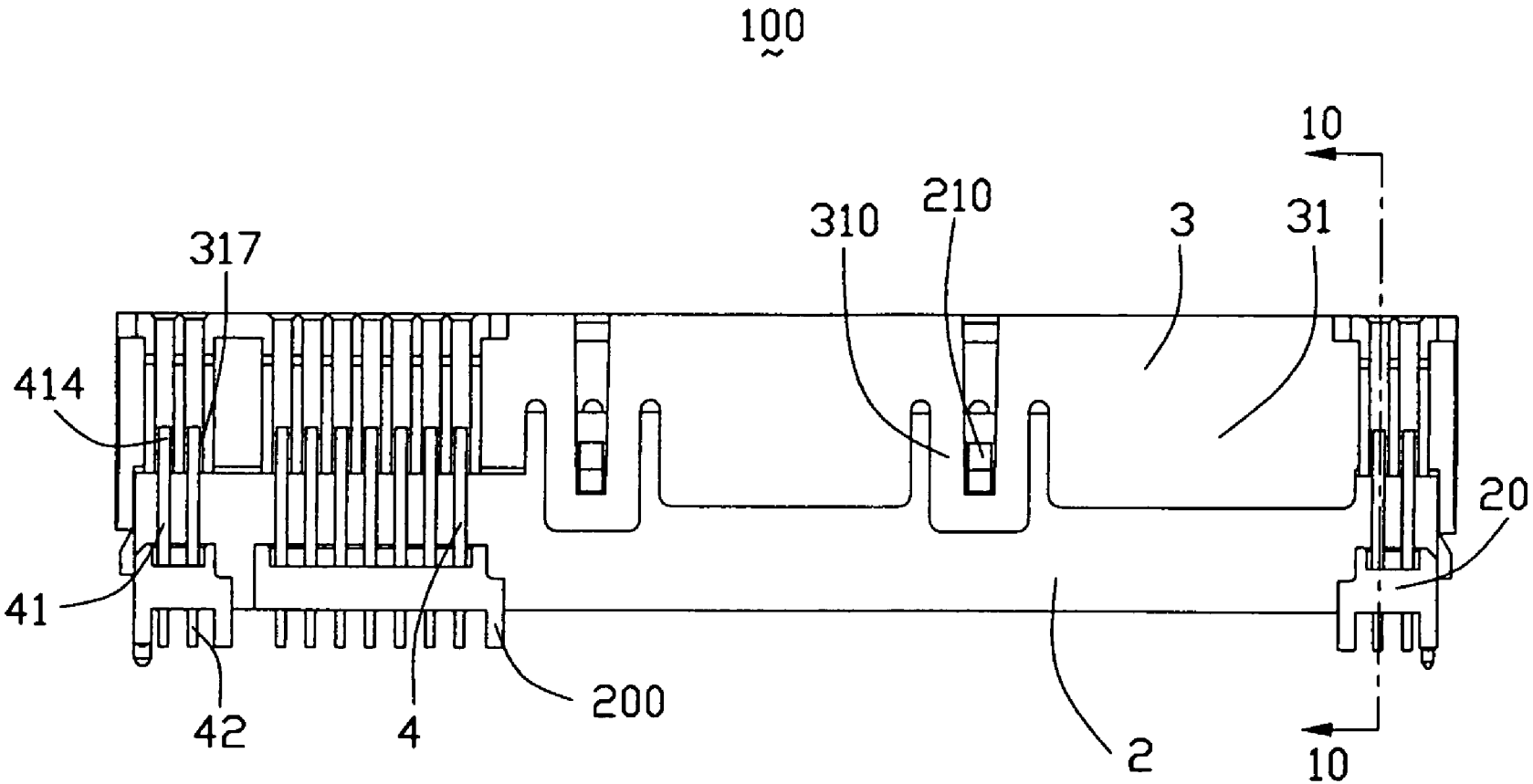
FIG. 9 is a side-elevational view of FIG. 8.
Figure 10:
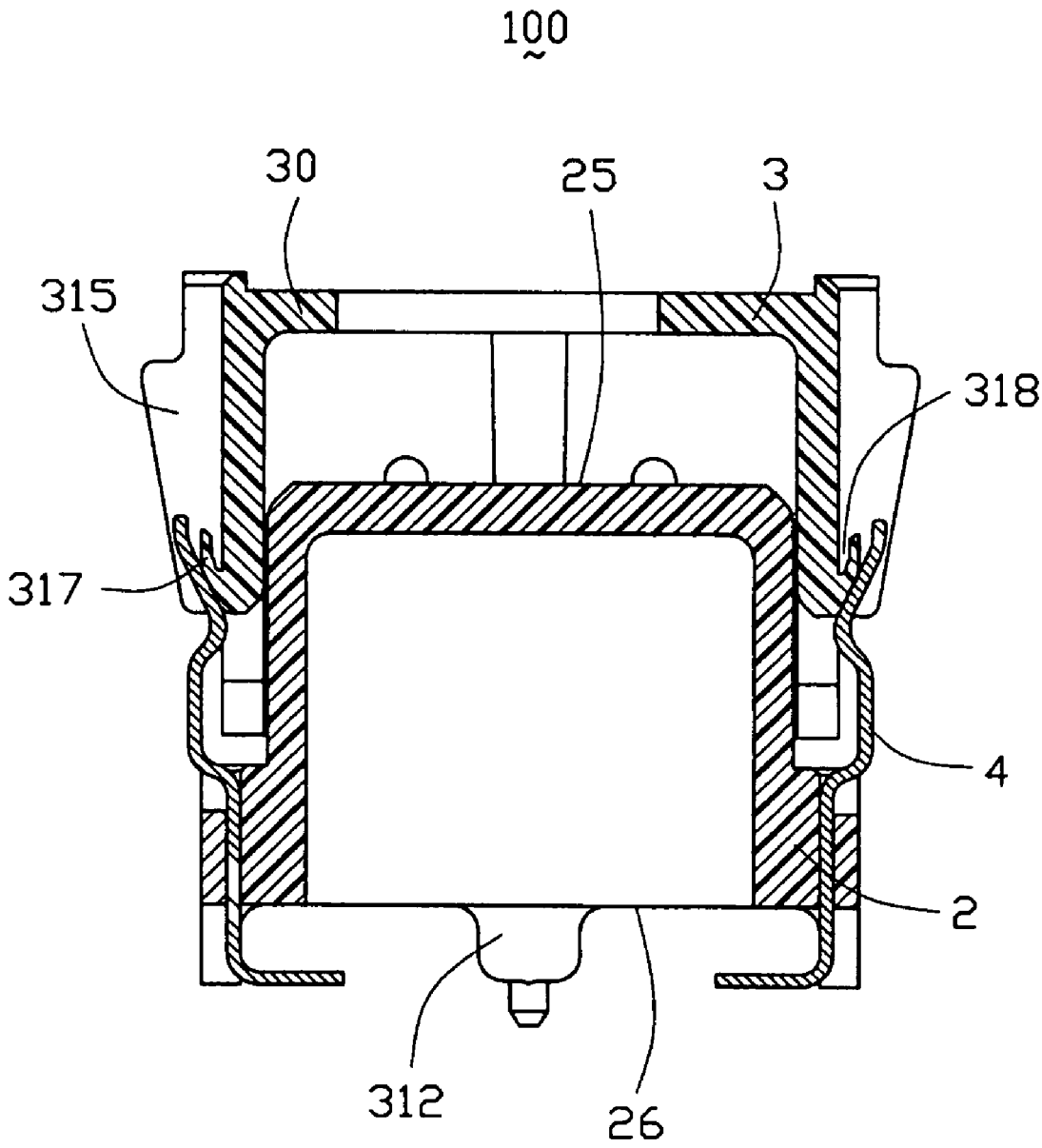
FIG. 10 a cross-sectional view taken along line 10—10 of FIG. 9.

In conjunction with FIGS. 5 and 6, the second housing piece 3 is of a rectangular shape and comprises an upper wall 30 and a side skirt 31 extending downwardly from the periphery of the upper wall 30. The side skirt 31 comprises a first and a second elongated walls 311, 312 and a first and a second sidewalls 313, 314 respectively connecting with the first and the second elongated walls 311, 312. The side skirt 31 forms a plurality of retaining sections 310 spaced arranged on the walls 311, 312, 313, 314 corresponding to the first and second latches 210, 230 of the first housing piece 2. The first and the second elongated walls 311, 312 respectively form a plurality of guards 315. A receiving space 316 is formed between two adjacent guards 315 corresponding to the contact passages 200 of the first housing piece 2. A claw 317 is formed in lower end of the receiving space 316, thus, a slit 318 is formed between the claw and bottom surface of the receiving space 316.

Referring to FIGS. 3 and 4, in assembly, the contacts 4 are firstly assembled to the first and the second longitudinal walls 21, 22 of the first housing piece 2. The retention portions 40 are interferentially engaged with the contact passages 200 with the tail portions 42 extending beyond the bottom surface 26 of the first housing piece 2. The tail portions 42 assembled to the first and second longitudinal walls 21, 22 are bent by tool toward each other. It should be noted that the curved mating sections 414 of the contacts 4 are not in contact with the longitudinal walls 21, 22.

Referring to FIGS. 7–10, the second housing piece 3 is assembled to the first housing piece 2 from the top of the first housing piece 2. The second housing piece 3 is pressed downwardly until the first latches 210 engage with the retaining sections 310 arranged on the first and second elongated walls 31, 32 thereof for preventing the second housing piece 3 from moving up. Bottom edges of the retaining sections 310 arranged on the first and second sidewalls 33, 34 locate above the second latches 230 of the first housing piece 2 for preventing the second housing piece 3 from going down. The first and second elongated walls 31, 32 and sidewalls 33, 34 of the side skirt 31 of the second housing piece 3 respectively partially overlap the first and second longitudinal walls 21, 22 and lateral walls 23, 24. The curved mating sections 414 of the contacts 4 are received in the receiving spaces 316 of the second housing piece 3. It should be noted that the curved mating sections 414 of the contacts 4 press on the bottom surfaces of the receiving spaces 316 an is in a preloaded state to create a retention force.

The first and second housing pieces 2, 3 with the contacts 4 go through solder reflow with the tail portions 42 of the contacts 4 surface mount on a printed circuit board. The standoffs 202 support the first and second housing pieces 2, 3 when soldering reflow. The polarization 232 inserts into corresponding hole of the printed circuit board for rigid position.

Figure 11:
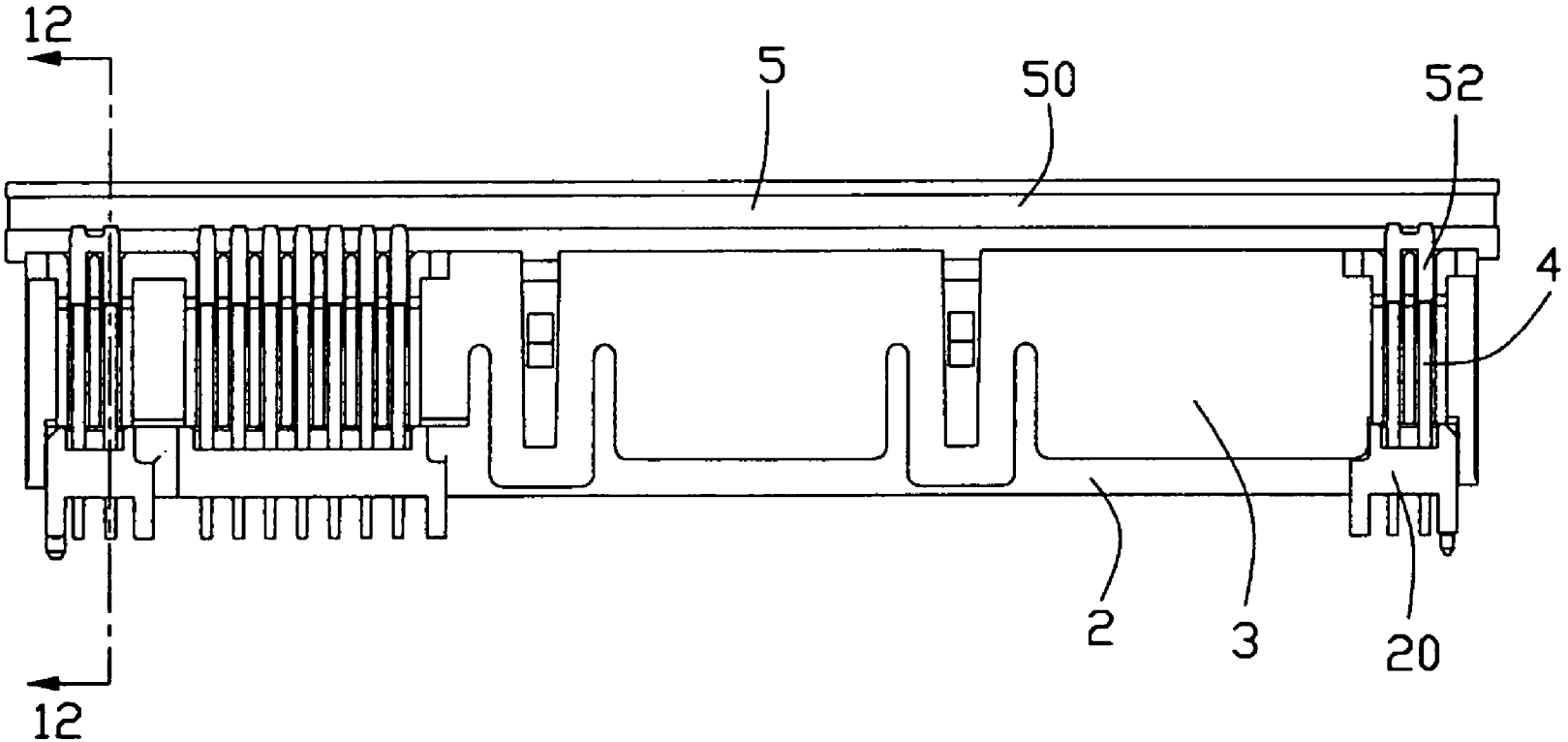
FIG. 11 is a side-elevational view of the assembled electrical connector with a VFT assembled therewith.
Figure 12:
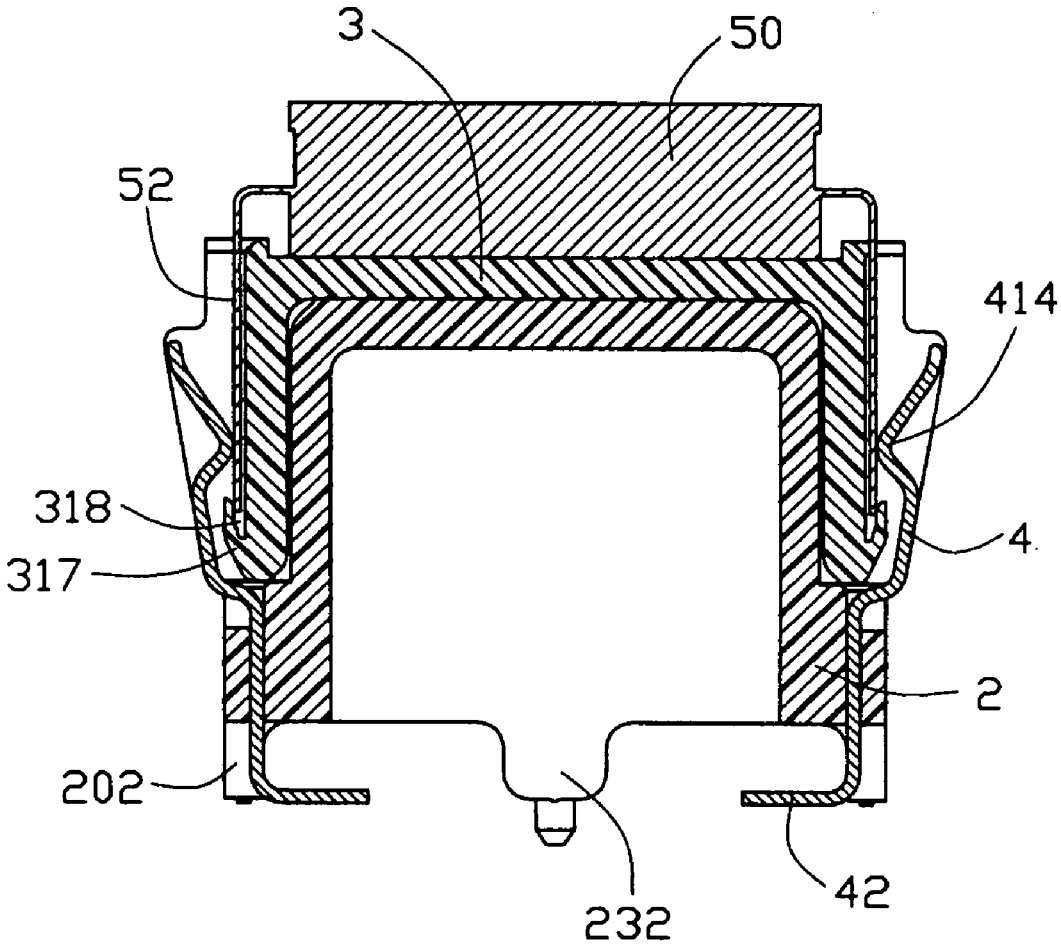
FIG. 12 is a cross-sectional view taken along line 12—12 of FIG. 11.
Figure 13:
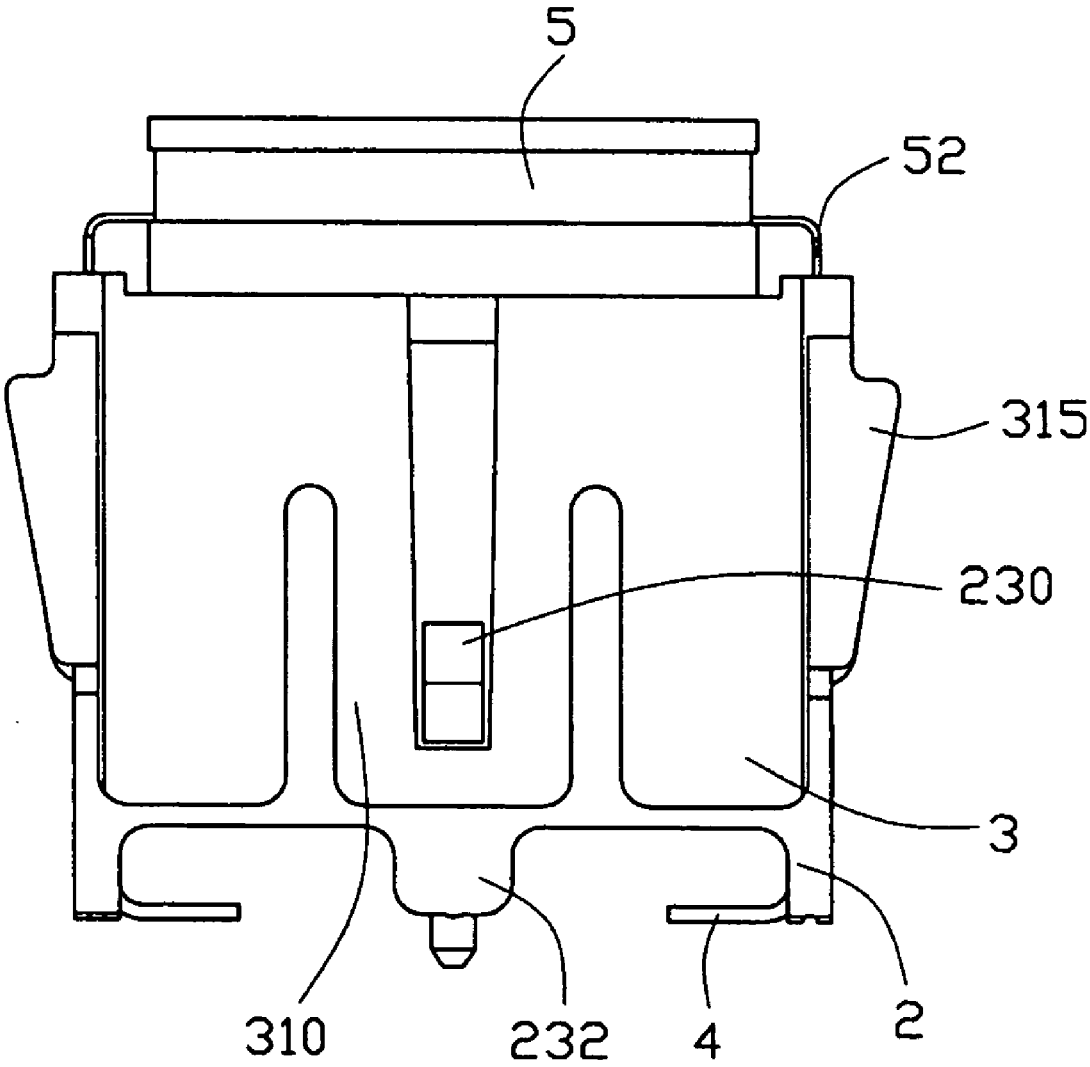
FIG. 13 is a side view illustrating the final assembled electrical connector with the VFT.

Referring to FIGS. 11–13, a VFT 5 (detailed structure is omitted here) is assembled to the second housing piece 3 from the top of the second housing piece 3. The VFT 5 comprises a body portion 50 and a plurality of leads 52 extending downwardly from the body portion 50. The VFT 5 is pressed downwardly until the second latches 230 of the first housing piece 2 engage with the retaining sections 310 of the first and second sidewalls 313, 314 of the second housing piece 3. The skirt 31 of the second housing piece 3 overlaps the walls 21, 22, 23, 24 of the first housing piece 2. With the lead in of the curved mating sections 414 of the contacts 4, the leads 52 of the VFT 5 is inserted into the receiving spaces 316 of the second housing piece 3 and located between the contacts 4 and the bottom surfaces of the receiving spaces 316 of the second housing piece 3 with a relatively low insertion force. Free ends of the leads 52 are also received in the slits 318 of the receiving spaces 316 for additional protection. With the retention force created by the curved mating sections 414 of the contacts 4, the electrical connection between the leads 52 and the contacts 4 is fairly reliable, thus, the VFT 5 is reliably connected with the printed circuit board.

With the assistance of the electrical connector 100, the VFT 5 realizes all SMD design with lower cost and reliable support. The vibration is also reduced via the electrical connector 100.

Of course, the contact 4 may have straight mating portion 41. The leads 52 insert between the straight mating portions 41 and the bottom surfaces of the receiving spaces 316 of the second housing piece 3 and are soldered with the straight mating portions 41 for reliable electrical connection therebetween. The insulative housing also can be made as a one-piece member and comprise a top wall, a bottom wall opposite to the top wall, and two lengthwise walls connecting with the top and bottom walls. The blocks 20 formed with the contact passages 200 and the guards 315 formed with the receiving spaces 316 may be formed on the lengthwise walls and respectively adjacent to the bottom wall and the top wall of the insulative housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing comprising at least a top wall, a bottom wall opposite to the top wall and two lengthwise walls connecting with the top and bottom walls;

a plurality of contact passages defined in the lengthwise wall, the contact passages located adjacent to the bottom wall and extending upwardly;

a plurality of guards defined in the lengthwise walls, and a receiving space corresponding to the contact passage defined between two adjacent guards; and a plurality of contacts assembled in the contact passages, each contact comprising a tail portion arranged adjacent to the bottom wall, and a mating portion extending in a corresponding receiving space between the guards; wherein the contact passages and the guards are formed on the outer side of the lengthwise walls of the insulative housing, and wherein the contacts are assembled to the outer side of the lengthwise walls; wherein the insulative housing comprises a first housing piece and a second housing piece interrelated with the first housing piece; wherein the contact passages are defined in the first housing piece; wherein first housing piece forms a plurality of blocks on longitudinal walls thereof, and wherein the contact passages are defined through the blocks; wherein the guards and the receiving spaces corresponding to the contact passages are formed on the second housing piece; wherein the first housing piece forms a plurality of first latches adjacent to a top surface thereof and a second latch adjacent to a bottom surface thereof, and wherein the second housing piece forms a plurality of retaining sections engaging with the first latches, while the second latch locates below corresponding retaining section; wherein the retaining section of the second housing piece engages with the second latch of the first housing piece with the first latches do not engage with the corresponding retaining sections; wherein the second housing piece comprises an upper wall attached to the top surface of the first housing piece and a skirt extending downwardly from the periphery of the upper wall and overlapping the walls of the first housing piece; wherein the retaining sections are arranged on the skirt of the second housing piece.

2. An electrical connector comprising:

a first insulative housing;

a plurality of contacts disposed in the housing and each having a deflectable mating portion laterally exposed to an exterior beside a corresponding outer surface thereof;

a second insulative housing compliantly assembled to the first housing and moveable relative to the first housing in a vertical direction between opposite first and second positions; and a plurality of receiving slots defined in an outer face of the second housing for receiving corresponding leads of an electronic component therein, respectively; wherein interengaging devices are formed on the first housing and the second housing to define said first and second positions of the second housing relative to the first housing, said contacts entering the corresponding receiving slots when said second housing is located at the first position while said contacts located outside of the corresponding receiving slots when said second housing is located at the second position; wherein when the second housing moves from the second position to the first position, the second housing invades a space formed between the outer surface of the first housing and the mating portion so as to outward deflect the deflectable mating portion.

3. An electrical connector assembly comprising:

an electrical connector comprising:

a first insulative housing;

a plurality of contacts disposed in the first housing and each having a deflectable mating portion laterally exposed to an exterior beside a corresponding outer surface thereof;

a second insulative housing compliantly assembled to the first housing and moveable relative to the first housing in a vertical direction between opposite first and second positions;

a plurality of receiving slots defined in an outer face of the second housing; and an electronic component seated upon the second housing and including a plurality of leads receiving within the corresponding receiving slots and against the outer face, respectively; wherein the electronic component is associated with the second housing to move in the vertical direction relative to the first housing between the first position where the contacts engage the corresponding leads, respectively, and the second position where the contacts are disengaged from the corresponding leases, respectively; wherein the leads are respectively sandwiched between the outer face of the second housing and the mating portions of the corresponding contacts.

4. The connector as claimed in claim 2, wherein a claw is formed at a distal end of each receiving slot so as to not only protect a tip of the corresponding lead of the electronic component but also outward deflect the corresponding contact during mating between the contact and the lead.

5. The connector as claimed in claim 3, wherein a claw is formed at a distal end of each receiving slot so as to not only protect a tip of the corresponding lead of the electronic component but also outward deflect the corresponding contact during mating between the contact and the lead.

* * * * *